US011114051B1

(12) United States Patent
Hai

(10) Patent No.: US 11,114,051 B1
(45) Date of Patent: Sep. 7, 2021

(54) METHOD, STORAGE MEDIUM AND DISPLAY DEVICE FOR ADJUSTING A DISPLAYED IMAGE

(71) Applicant: TCL CHINA STAR OPTOELECTRONICS TECHNOLOGY CO., LTD., Guangdong (CN)

(72) Inventor: Bo Hai, Guangdong (CN)

(73) Assignee: TCL CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 17/053,168

(22) PCT Filed: Sep. 8, 2020

(86) PCT No.: PCT/CN2020/113871

§ 371 (c)(1),
(2) Date: Nov. 5, 2020

(30) Foreign Application Priority Data

Aug. 12, 2020 (CN) ..... 202010807732.7

(51) Int. Cl.
*G09G 3/36* (2006.01)

(52) U.S. Cl.
CPC ... *G09G 3/3607* (2013.01); *G09G 2320/0233* (2013.01); *G09G 2320/0242* (2013.01)

(58) Field of Classification Search
CPC ..... G09G 3/3607; G09G 2320/0233; G09G 2320/0242
See application file for complete search history.

(56) References Cited

U.S. PATENT DOCUMENTS 6,111,607 A * 8/2000 Kameyama ..... G06T 5/009 348/255
2013/0155121 A1 6/2013 Kang
2015/0312539 A1 10/2015 Wu et al.
2019/0213951 A1* 7/2019 Li ..... G09G 3/3208
2021/0027726 A1 1/2021 Lee et al.

FOREIGN PATENT DOCUMENTS

CN 102394041 A 3/2012
CN 103928012 A 7/2014
CN 107610642 A 1/2018
CN 107665677 A 2/2018
CN 107799081 A 3/2018
CN 108182914 A 6/2018
CN 110136631 A 8/2019

* cited by examiner

*Primary Examiner* — Gene W Lee

(57) ABSTRACT

Disclosed is a method for adjusting a displayed image. The method includes obtaining brightness information of a plurality of color channels of a currently displayed image; determining a target color channel with abnormal brightness from the plurality of color channels based on the brightness information; obtaining stimulus information of the target color channel, and determining a target grayscale from a predetermined grayscale interval based on the stimulus information; and determining brightness and chromaticity corresponding to the target grayscale, and adjusting the displayed image based on the brightness and chromaticity corresponding to the target grayscale.

20 Claims, 4 Drawing Sheets

METHOD, STORAGE MEDIUM AND DISPLAY DEVICE FOR ADJUSTING A DISPLAYED IMAGE

FIELD OF THE DISCLOSURE

The present application relates to display technologies, and more particularly to a method, device, storage medium and display device for adjusting a displayed image.

DESCRIPTION OF RELATED ARTS

Along with the development of display panel technologies and user requirements on high resolution of display devices, liquid crystal display panels are widely used in display devices.

In related arts, when a liquid crystal display panel is used to display image frames of a video, obvious brightness differences occur on a same image frame.

Technical Problems

Embodiments of the present application provide a method, device, storage medium and display device for adjusting a displayed image, capable of solving the problem of image quality affected by brightness differences in existing arts when image frames of a video are displayed.

Technical Solutions

In a first aspect, an embodiment of the present application provides a method for adjusting a displayed image, including:

obtaining brightness information of a plurality of color channels of a currently displayed image;

determining a target color channel with abnormal brightness from the plurality of color channels based on the brightness information;

obtaining stimulus information of the target color channel, and determining a target grayscale from a predetermined grayscale interval based on the stimulus information; and determining brightness and chromaticity corresponding to the target grayscale, and adjusting the displayed image based on the brightness and chromaticity corresponding to the target grayscale.

In a second aspect, an embodiment of the present application provides a storage medium storing a plurality of instructions, which are loaded by a processor to execute the foregoing method for adjusting the displayed image.

In a third aspect, an embodiment of the present application provides a display device, which includes the foregoing device for adjusting the displayed image, the device for adjusting the displayed image configured to execute the foregoing method for adjusting the displayed image.

Beneficial Effects

The solution of this application collects image frames with abnormal brightness, extracts the brightness information of the image frame, determines abnormal grayscale information of the image frame based on the brightness information, and adjusts display parameters of the image frame based on the abnormal grayscale information in order to reduce the brightness difference of the image frame, thereby improving the quality of displayed images.

DESCRIPTION OF DRAWINGS

For explaining the technical solutions used in the embodiments of the present application more clearly, the appended figures to be used in describing the embodiments will be briefly introduced in the following. Obviously, the appended figures described below are only some of the embodiments of the present application, and those of ordinary skill in the art can further obtain other figures according to these figures without making any inventive effort.

DESCRIPTION OF EMBODIMENTS OF THE DISCLOSURE

The technical solutions in the embodiments of the present application are clearly and completely described below with reference to appending drawings of the embodiments of the present application. Obviously, the described embodiments are merely a part of embodiments of the present application and are not all of the embodiments. Based on the embodiments of the present application, all the other embodiments obtained by those of ordinary skill in the art without making any inventive effort are within the scope the present application.

Based on above problems, an embodiment of the present application provides a method, device, storage medium and display apparatus for adjusting a displayed image, which are capable of improving the quality of displayed image. Detailed description is provided below. It is noted that the order in describing the following embodiments is not intended to be treated as an order of preferred embodiments.

Figure 1:
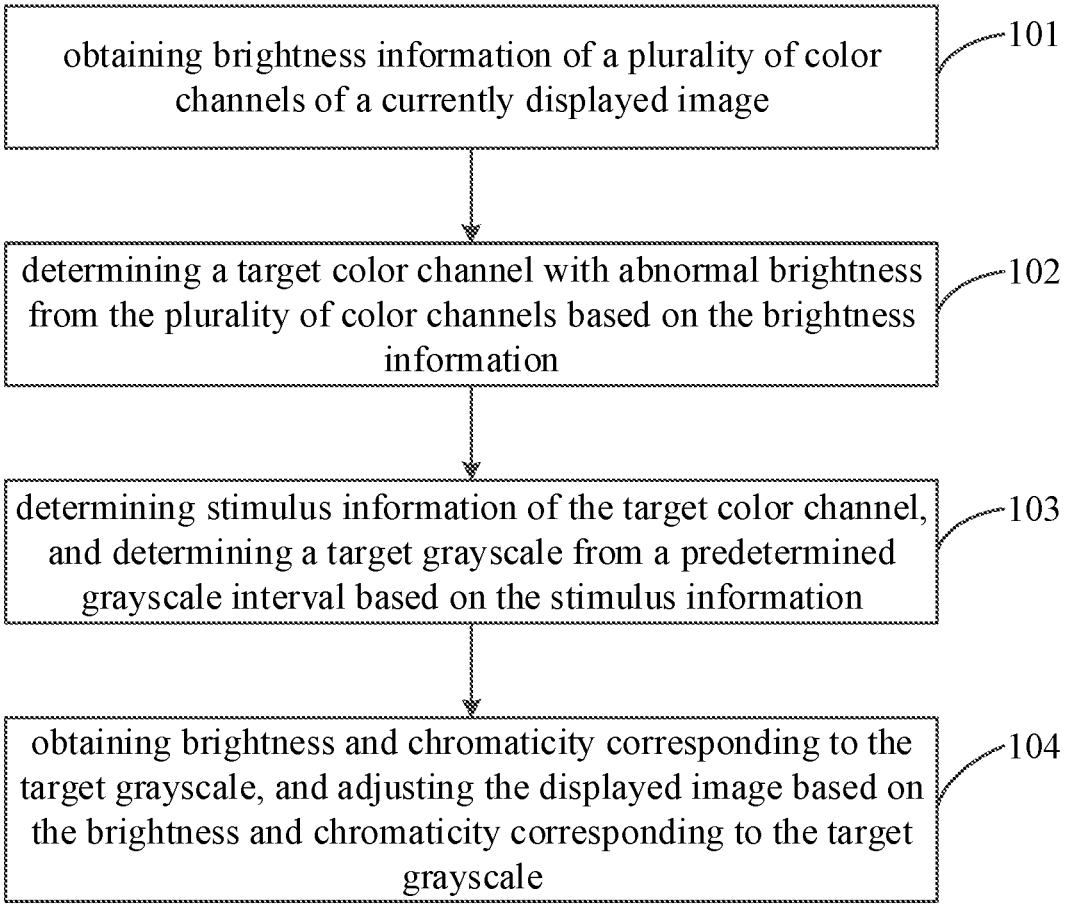
FIG. 1 is a flowchart of a method for adjusting a displayed image provided in an embodiment of the present application.

FIG. 1 is a flowchart of a method for adjusting a displayed image provided in an embodiment of the present application. The method for adjusting the displayed image can be applied to display apparatuses such as televisions. The method for adjusting the displayed image is described in detail below.

Step 101—obtaining brightness information of a plurality of color channels of a currently displayed image.

The currently displayed image may be a video frame image obtained during video playback. The video frame image may be a video frame image with abnormal image brightness. The abnormality of image brightness may occur on a same video image. There is a brightness difference between display areas of a same color. Various ways may be used to capture the video frame image, for example, by inputting a program instruction. The video frame image may be obtained by the program instruction, and is taken as the currently displayed image.

For instance, a user can play a video through a display apparatus. When the brightness of the video frame is abnormal, the user may pause the video playback and capture a current video frame image by inputting a program instruction. The current video frame image serves as the currently displayed image.

After the currently displayed image is obtained, it turns to obtain brightness information of a plurality of color channels of the currently displayed image. The plurality of color channels may include a red channel, a green channel and a blue channel.

In an embodiment, each image has one or more color channels. The number of color channels the image inherently has depends on its color mode, that is, the color mode of an image decides the number of color channels the image has. For example, a RGB image has three channels, that is, red channel, green channel and blue channel. In a default, there is only one channel for bitmap scale, gray scale, duotone scale and index mode images.

Each color channel stores the information of color elements in the image. Colors in all the color channels are overlaid and mixed to generate the colors of pixels in the image. For example, taking RGB mode images as an example, the principle regarding its color channels is described below. Basic units that constitutes an image are established based on RGB. For this, it can be understood that an image is composed of three elements such as RGB, where R is a red channel, indicated by 1; G is a green channel, indicated by 2; B is a blue channel, indicated by 3; a white image is indicated by 4, which is a mixture of colors of the channels of 1, 2 and 3. This is equivalent to a color palette we use. Several colors are mixed together to produce a new color.

In some embodiments, before the step of obtaining the brightness information of the plurality of color channels of the currently displayed image, the method may further include:

in response to detecting a display of images, determining whether a display condition of the display apparatus meets a predetermined display condition;

if not, resetting display parameters corresponding to the display condition of the display apparatus.

The displayed images may be of a plurality of types. For example, they may be still images, images of a dynamic video, and so on. A user display instruction may be received and the images are displayed based on the display instruction. The display apparatus can be a television, and the user can trigger the display instruction in a variety of ways. For example, the user may trigger the display apparatus to start displaying images by manipulating a physical button of the display apparatus, performing a touch operation on a display screen or by other operations of a remote-control device.

In an embodiment, the display condition of the display apparatus may include a setting of different display parameters. The display parameters may include parameters related to brightness or chromaticity that are set in the current display apparatus before it leaves the factory. These parameters are such as white balance, grayscale, color saturation, and etc. They can improve image display quality. For example, the display parameters can be used to improve the brightness, contrast and/or color saturation of the images of a video when the video is played on the display apparatus.

In the present embodiment, the display parameters may include white balance, which is a very important concept in the fields of television and photography, and a series of problems of color reproduction and white-balance tone processing can be solved through it. The concept of white balance is brought as electronic images are desired to be reproduced with true color. White balance has been used earlier in the field of professional photography. It can be realized that camera images accurately reflect the color of photographed objects. There are custom white balance and automatic white balance. Its principle is described below. There are three types of electronic coupling components—image sensors or charge coupled devices (CCDs), inside the camera, and they perceive blue, green and red light, respectively. Under a default condition, amplification ratios of these three types of photosensitive electric circuits are the same, that is, 1:1:1. White balance adjustment is to change this proportional relation based on a to-be-adjusted view or scene. For example, the ratio of blue, green and red light of the to-be-adjusted view or scene is 2:1:1 (the percentage of blue light is high, having higher color temperature). Then, after the white balance adjustment, the ratio is changed to 1:2:2. In the adjusted amplification ratio, the percentage of blue light obviously decreases and the percentage of green and red light increases. In such a way, the percentages of blue, green and red of an image of the view or scene captured using a white balance adjusting circuit will be the same. That is to say, if a white scene that is to be adjusted appears a little blue, the white balance adjustment will change a common proportion to weaken amplification of a circuit relating to blue and meanwhile increase the percentages of green and red, so that the resulting image is still white.

After color rendering parameters are determined, parameter values of the color rendering parameters can be obtained. Parameter values of white balance can be preset, and these parameter values can be adjusted thereafter. Specifically, the white balance parameter values can be correspondingly set according to actual needs. For example, the white balance parameter values can be set to 0. It may indicate that a white balance function of the display apparatus is turned off. At this time, the display effect of images from the video playback is as the same as an original display effect.

After the display parameters are adjusted, the images may continue to be displayed based on the adjusted display parameters.

Step 102—determining a target color channel with abnormal brightness from the plurality of color channels based on the brightness information.

The brightness information of the color channel may include a brightness value of each grayscale in the color channel. The grayscale refers to the division of the difference between the maximum brightness and the minimum brightness into a plurality of parts, which provides convenience for the control of screen brightness corresponding to signal input. Each digital image is composed of a plurality of points. These points are also referred to as pixels. In general, each pixel may show many different colors, for instance, is composed of three subpixels RGB. Light sources on the back of each subpixel may show different brightness levels. The grayscale represents the level of different brightness values between the maximum brightness to the minimum brightness. When the middle levels are more, the image effect capable of being presented is more delicate. For instance, 8 bits can show eighth power of 2 and is equal to 256 brightness levels, which are referred to as 256 grayscales. Each pixel on a liquid crystal display (LCD) screen is composed of RGB with different brightness levels, and finally different color points are formed. That is to say, the color change of each point on the screen is actually brought by the change of the grayscales of the three subpixels RGB for forming the point.

In some embodiments, the brightness information may include brightness curves, and the brightness curves are configured to represent brightness values varied with gray values. The step of determining the target color channel with abnormal brightness from the plurality of color channels based on the brightness information may include:

obtaining a brightness difference corresponding to every two adjacent grayscales based on the brightness curves; and in response to the brightness difference not within a predetermined range of differences, determining the color channel corresponding to the brightness difference as the target color channel.

Color information of each color channel may include a grayscale brightness variation curve. For example, grayscales within a predetermined grayscale interval may be taken as an axis and brightness values may be taken as another axis. A coordinate system is established by these two axes. A plurality of coordinates are determined based on the brightness value corresponding to each grayscale. By connecting all the coordinates, it can be determined a grayscale brightness variation curve for each color channel. The predetermined grayscale interval may include 0 to 255 grayscales.

After the grayscale brightness variation curve is obtained for each color channel, it may calculate a brightness difference corresponding to every two adjacent grayscales. For example, a start point of the grayscale axis may be a 0-th grayscale, and may include a first grayscale, a second grayscale, a third grayscale, . . . , a 255-th grayscale arranged sequentially along an arrow direction of the grayscale axis. Accordingly, it may obtain a brightness difference between the first grayscale and the 0-th grayscale, a brightness difference between the second grayscale and the first grayscale, a brightness difference between the third grayscale and the second grayscale, . . . , a brightness difference between the 255-th grayscale and the 254-th grayscale. All of the brightness differences are compared to a predetermined range of differences.

The predetermined range of differences may be 0.01 to 0.02, but the present invention is not limited thereto. It may be deployed based on practical situations. The deployment of the predetermined range of differences can be used to determine whether uniformity of brightness of each grayscale is qualified. If the brightness difference is within the predetermined range of differences, it can be determined that uniformity of brightness of each grayscale is qualified for the color channel. If the brightness difference is not within the predetermined range of differences, it can be determined that grayscale brightness variation of the color channel is abnormal, and the color channel can be determined as the target color channel.

Step 103—obtaining stimulus information of the target color channel, and determining a target grayscale from a predetermined grayscale interval based on the stimulus information.

After the target color channel is determined, it may obtain stimulus information of the color channel.

The stimulating amount may include lots of entities. In a trichromatic system, it may refer to the three primary colors stimulating amount as required to reach the color matching with the light to be measured. They are represented by X (red primary color stimulating amount), Y (green primary color stimulating amount) and Z (blue primary color stimulating amount), respectively. The act of perceiving a color is a synthesis of stimulating amounts of the three primary colors of light. In the RGB color space, the tristimulus values of red, green, and blue are represented by R value, G value, and B value, respectively. Since the three primary colors of red, green and blue selected from the actual spectrum are impossible to be mixed to represent all the colors that exist in nature, Commission Internationale de L'Eclairage (CIE) theoretically assumed in 1931 three primary colors which do not exist in nature, that is, three theoretical primary colors, and are represented by X, Y, and Z. These three theoretical primary colors are proposed to theoretically represent all the colors in nature. A XYZ color measuring system is therefore formed. The primary color X can be understood as a red/purple color with saturation higher than spectral red. The primary color Y can be understood as a green color with saturation higher than spectral green with wavelength of 520 nm. The primary color Z can be understood a blue color with saturation higher than spectrum blue with wavelength of 477 nm. Stimulating amounts of these three theoretical primary colors are represented by X, Y and Z, respectively, that is, the so-called tristimulus values.

The stimulus information of the target color channel may include a stimulus value X, a stimulus value Y and a stimulus value Z at each grayscale.

In an embodiment, the stimulus information may include a plurality of stimulus curves, and the stimulus curves are configured to represent the stimulus values varied with grayscales. The LeClair step of determining the target grayscale from the predetermined grayscale interval based on the stimulus information may include:

(1) determining a trend of variation of each stimulus curve;

(2) determining an abnormal stimulus curve from the plurality of stimulus curves based on the trend of variation; and (3) determining the target grayscale from the predetermined grayscale interval based on stimulus variation information of the abnormal stimulus curve.

The stimulus information may include stimulus curves for primary-color stimulating amount X, primary-color stimulating amount Y and primary-color stimulating amount Z. For example, grayscales within a predetermined grayscale interval may be taken as an axis and stimulus values may be taken as another axis. A coordinate system is established by these two axes. A plurality of coordinates are determined based on the stimulus value corresponding to each grayscale. By connecting all the coordinates, it can be determined a stimulus curve for each primary-color stimulating amount.

After the stimulus curves corresponding to the primary-color stimulating amount X, the primary-color stimulating amount Y and the primary-color stimulating amount Z are obtained, the target grayscale can be determined from the predetermined grayscale interval based on a trend of variation of each stimulus curve.

In an embodiment, the step of determining the abnormal stimulus curve from the plurality of stimulus curves based on the trend of variation may include:

(2.1) determining an amount of changes in stimulus values of the stimulus curves from each grayscale to an adjacent next grayscale based on the trend of variation; and (2.2) in response to the amount of changes greater than a predetermined amount of changes, determining the stimulus curve corresponding to the amount of changes as the abnormal stimulus curve.

The trend of variation of the stimulus curve may include a change of stimulus values of every two adjacent grayscales. The information regarding the trend of variation may include a change of value from each grayscale to an adjacent next grayscale within the predetermined grayscale interval.

The predetermined grayscale interval may include 0 to 255 grayscales. A sample grayscale may be 0-th, 1-st, 2-nd, . . . , or 255-th grayscale. For example, the predetermined grayscale interval in the coordinate space for the stimulus curves may be arranged as 0-th, 1-st, 2-nd, . . . , and 255-th grayscales. Then, a change of stimulus values from each grayscale to an adjacent next grayscale may be a change of value from a stimulus value corresponding to the 0-th grayscale to a stimulus value corresponding to the 1-st grayscale, and the like. A change of stimulus values corresponding to adjacent grayscales are sequentially obtained in such way.

For example, the predetermined grayscale interval in the coordinate space for the stimulus curves may be arranged as 255-th, 254-th, 253-th, . . . , and 0-th grayscales. Then, a change of stimulus values from each grayscale to an adjacent next grayscale may be a change of value from a stimulus value corresponding to the 255-th grayscale to a stimulus value corresponding to the 254-st grayscale, and the like. A change of stimulus values corresponding to adjacent grayscales are sequentially obtained in such way.

In an embodiment, the step of determining the target grayscale from the predetermined grayscale interval based on the stimulus variation information of the abnormal stimulus curve may include:

(3.1) obtaining a first stimulus value and a second stimulus value of the abnormal stimulus curve, wherein the first stimulus value is a first maximum of the stimulus values of the abnormal stimulus curve, and the second stimulus value is a stimulus value of a highest grayscale within the predetermined grayscale interval on the abnormal stimulus curve;

(3.2) obtaining a stimulus-value difference between the first stimulus value and the second stimulus value; and (3.3) in response to the stimulus-value difference greater than a predetermined threshold, taking the grayscale corresponding to the first stimulus value of the abnormal stimulus curve as the target grayscale.

The stimulus curve may include a first stimulus value and a second stimulus value. The first stimulus value may be a maximum stimulus value of the stimulus curve. The second stimulus value may be the stimulus value corresponding to the 255-th grayscale.

After the first stimulus value and the second stimulus value corresponding to the abnormal stimulus curve are obtained, a stimulus-value difference between the first stimulus value and the second stimulus value may be calculated for the abnormal stimulus curve. The stimulus-value difference is compared with a predetermined threshold. If the stimulus-value difference is greater than the predetermined threshold, the grayscale corresponding to the first stimulus value of the abnormal stimulus curve may be taken as the target grayscale. The difference between the first stimulus value and the second stimulus value represents a value obtained by subtracting the second stimulus value from the first stimulus value. By comparing the difference between the first stimulus value and the second stimulus value with the predetermined threshold and determining whether the stimulus value corresponding to a sample grayscale of the stimulus value is greater than the gray value corresponding to the 255-th grayscale, a grayscale of inversion (i.e., the target grayscale) can be determined from the abnormal stimulus curve.

In an embodiment, the step of determining the target grayscale from the predetermined grayscale interval based on the stimulus variation information may further include:

from the plurality of stimulus curves, determining the stimulus curve, on which a second maximum of the stimulus values is, and taking the determined stimulus curve as a target stimulus curve; and determining a grayscale corresponding to the maximum of the stimulus values from the target stimulus curve, and taking the determined grayscale as the target grayscale.

Specifically, by obtaining a maximum of stimulus values for each stimulus curve and comparing a plurality of maximum stimulus values with each other, it can be determined a maximum stimulus value among the maximum values, and a grayscale corresponding to the maximum stimulus value is taken as the target grayscale.

Step 104—determining brightness and chromaticity corresponding to the target grayscale, and adjusting the displayed image based on the brightness and chromaticity corresponding to the target grayscale.

The brightness and chromaticity of the target grayscale may be a brightness value and a chromaticity value corresponding to current target grayscale. By using a predetermined way to calculate the brightness value and the chromaticity value, the brightness value and the chromaticity value of each grayscale before the target grayscale can be obtained.

In some embodiments, the step of adjusting the brightness and chromaticity of the displayed image based on the brightness and chromaticity corresponding to the target grayscale may include:

determining whether the target grayscale is the highest grayscale within the predetermined grayscale interval;

if not, updating the brightness value and the chromaticity of the highest grayscale based on the brightness value and the chromaticity of the target grayscale;

processing the brightness value and the chromaticity value of the other grayscales within the predetermined grayscale interval based on the updated brightness value and chromaticity value of the highest grayscale.

After the target grayscale is determined, it can first determine whether the target grayscale is the highest grayscale within the predetermined grayscale interval, that is, the 255-th grayscale. If the target grayscale is not the highest grayscale, the brightness and chromaticity of the target grayscale is taken as the brightness and chromaticity of the highest grayscale. Correspondingly, when the brightness and chromaticity of the highest grayscale is adjusted, the brightness and chromaticity of other grayscales are processed.

In an embodiment, the step of adjusting the displayed image based on the brightness and chromaticity corresponding to the target grayscale may include:

obtaining a brightness parameter value corresponding to the brightness and a chromaticity parameter value corresponding to the chromaticity;

obtaining a brightness difference of two adjacent grayscales;

determining a target brightness value of each grayscale in the predetermined grayscale interval based on the brightness parameter value and the brightness difference; and adjusting the brightness value of each grayscale based on the target brightness value of each grayscale, and adjusting a chromaticity value of each grayscale based on the chromaticity parameter value of the target grayscale.

Specifically, the brightness and chromaticity of other grayscales are processed based on the brightness and chromaticity of the target grayscale. First, the brightness of other grayscales is processed. The brightness of each grayscale can be calculated based on the brightness of the target grayscale and a brightness curve Gamma 2.2. Gamma is a parameter used to characterize a brightness response of a display device. The relation between the brightness presented by a display device and an input level is usually similar to an exponential curve. The Gamma curve is a special tone curve. When Gamma value is equal to 1, the curve is a straight line inclined by 45 degrees with respect to a coordinate axis. This represents that input and output are the same. The Gamma values higher than 1 will make the output brighter, and the Gamma values lower than 1 will make the output darker. In short, our requirements are to make a ratio of the input to the output as close to 1 as possible.

In the present embodiment, the Gamma value can be 2.2. The brightness value of the target grayscale can be calculated by the following formula: a^Gamma, where a=gray/255, that is, the ratio of the target grayscale to 255. For example, the target gray scale may be 254, and then according to a=gray/255, the value of a can be obtained as 0.996. According to the formula a^Gamma, it is determined that the brightness value of the target gray scale can be 0.991. After the brightness value of each grayscale is determined, the brightness value of each grayscale is adjusted.

After the brightness value of the target grayscale is determined, the brightness value of the highest grayscale can be adjusted to the brightness value of the target grayscale. After that, the brightness value corresponding to each grayscale is sequentially set based on a predetermined brightness difference between every two adjacent grayscales. For example, the brightness value of the 255-th grayscale is 0.991. The predetermined brightness difference can be 0.004. It can be calculated that the brightness value of the 254-th grayscale is 0.987, the brightness value of the 253-th grayscale is 0.983, . . . , and the brightness value of the 0-th grayscale is 0, and so on.

Secondly, the chromaticity values of other grayscales are adjusted based on the chromaticity value of the target grayscale. Chromaticity x and chromaticity y of the target grayscale are calculated based on the stimulus information of the target grayscale and based on a predetermined formula. Specifically, the chromaticity of each grayscale is generally represented by both x and y. Grayscale chromaticity x=X/(X+Y+Z) and grayscale chromaticity y=Y/(X+Y+Z), where XYZ are the tristimulus values defined in colorimetry. The tristimulus value of each grayscale=a sum of R+G+B tristimulus values. That is, in a current image, a sum of the tristimulus values corresponding to the 255-th grayscale=(red X+green X+blue X)+(red Y+green Y+blue Y)+(red Z+green Z+blue Z). The grayscale chromaticity x=(red X+green X+blue X)/[(red X+green X+blue X)+(red Y+green Y+blue Y)+(red Z+green Z+blue Z)]. The grayscale chromaticity y=(red Y+green Y+blue Y)/[(red X+green X+blue X)+(red Y+green Y+blue Y)+(red Z+green Z+blue Z)].

For example, assuming that the target grayscale is 254, the value of red X is 140, the value of green X is 180 and the value of blue X is 150 for the corresponding 254-th grayscale; the value of red Y is 80, the value of green Y is 320 and the value of blue Y is 50 for the corresponding 254-th grayscale; and the value of red Z is 10, the value of green Z is 5, and the value of blue Z is 700 for the corresponding 254-th grayscale. Then, according to the aforesaid formula, the grayscale chromaticity x is 0.279 and the grayscale chromaticity is 0.268 for the 254-th grayscale. After the grayscale chromaticity of the highest grayscale is determined, the grayscale chromaticity of other grayscales may be set to be as the same as the grayscale chromaticity of the highest grayscale, based on the principle of white balance adjustment. That is, the grayscale chromaticity x is set to 0.279 and the grayscale chromaticity is set to 0.268 for other grayscales. In such a way, it can be realized that the brightness and chromaticity of other grayscales are adjusted based on the brightness and chromaticity of the target grayscale, thereby improving the quality of displayed images.

The embodiment of the present application discloses a method for adjusting a displayed image. The method includes obtaining brightness information of a plurality of color channels of a currently displayed image; determining a target color channel with abnormal brightness from the plurality of color channels based on the brightness information; obtaining stimulus information of the target color channel, and determining a target grayscale from a predetermined grayscale interval based on the stimulus information; and determining brightness and chromaticity corresponding to the target grayscale, and adjusting the displayed image based on the brightness and chromaticity corresponding to the target grayscale. The solution of this application collects image frames with abnormal brightness, extracts the brightness information of the image frame, determines abnormal grayscale information of the image frame based on the brightness information, and adjusts display parameters of the image frame based on the abnormal grayscale information in order to reduce the brightness difference of the image frame, thereby improving the quality of displayed images.

Figure 2:
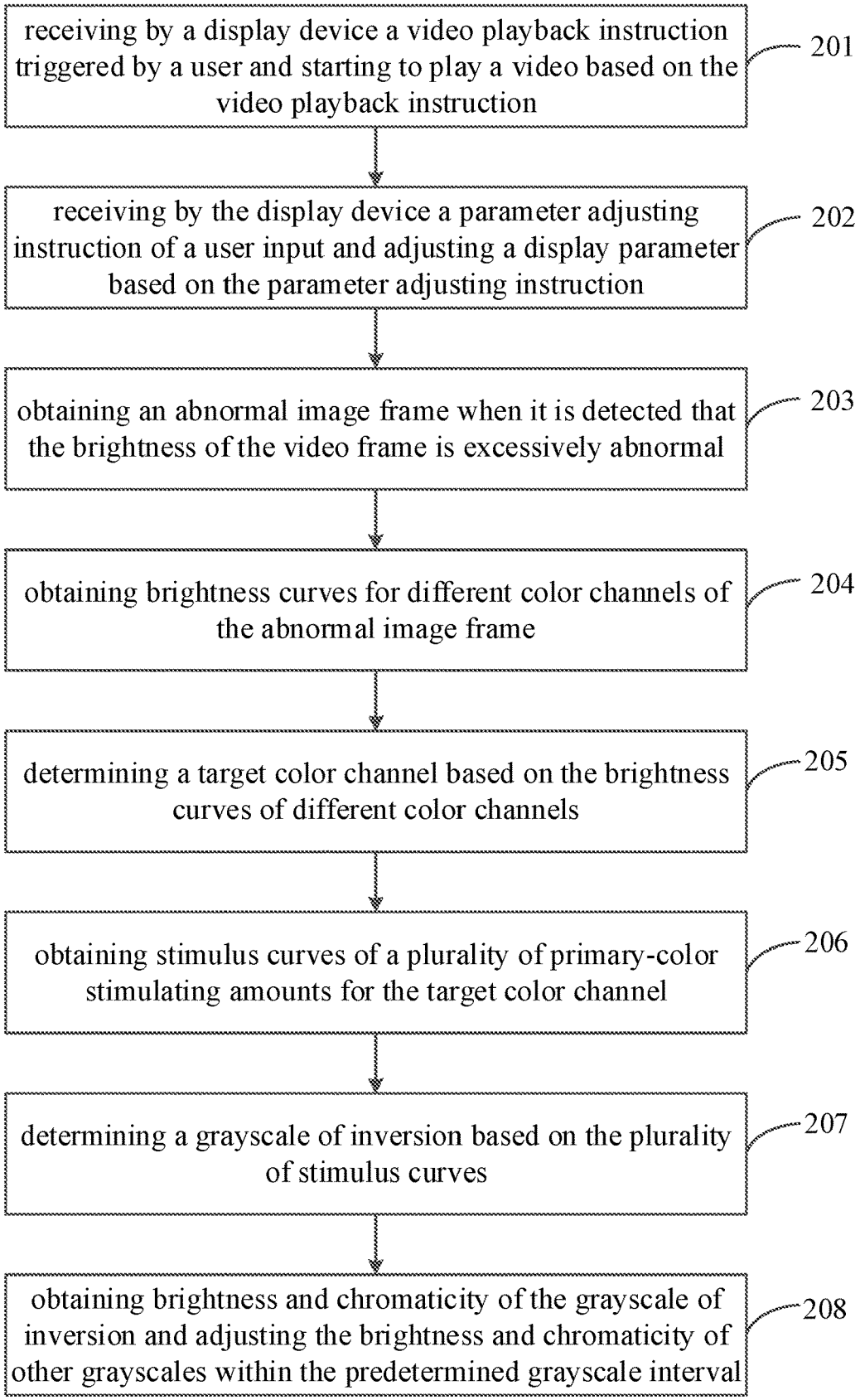
FIG. 2 is a flowchart of another method for adjusting a displayed image provided in an embodiment of the present application.

FIG. 2 is a flowchart of another method for adjusting a displayed image provided in an embodiment of the present application. The scenarios which the method for adjusting the displayed image can apply are described below.

Step 201—receiving by a display device a video playback instruction triggered by a user and starting to play a video based on the video playback instruction.

In an embodiment, the display device can be a television and the television has a display panel, which can be a liquid crystal display panel. The user may turn on a switch of the display device to initialize the display device and choose a video for playing the video. The video can be a local video and can also be an on-line video.

The video starts to play as long as the display device receives the playback instruction from the user. A display screen of current display device is a video playback interface.

Step 202—receiving by the display device a parameter adjusting instruction of a user input and adjusting a display parameter based on the parameter adjusting instruction.

The parameter adjusting instruction can be an instruction for turning off a white balance function of the display device. For example, when current display device is playing a video with a white balance parameter that has been set, by receiving the parameter adjusting instruction from the user to adjust a value of the white balance parameter to 0, turning off the white balance function of the current display device is realized.

Step 203—obtaining an abnormal image frame when it is detected that the brightness of the video frame is excessively abnormal.

In the process of video playback, when the user observes that the brightness of the video frame is abnormal, the image frame with abnormal brightness can be obtained, serving as an abnormal image frame. The phenomenon of abnormal brightness has been described in the foregoing embodiments and will not be repeated here. The abnormal image frame can be obtained by various ways. For example, an external program control may be utilized to obtain a video frame in the video, that is, an initial image frame. This can assure maximum restoration of image information of the obtained abnormal image.

Step 204—obtaining brightness curves for different color channels of the abnormal image frame.

Specifically, after the abnormal image frame is captured, the abnormal image frame can be loaded into an image processing application to analyze it to obtain the brightness curves of the abnormal image frame with respect to different color channels. Since the embodiment of the present application may be a display device such as a television, the color channels may include a red channel, a green channel and a blue channel.

Figure 3:
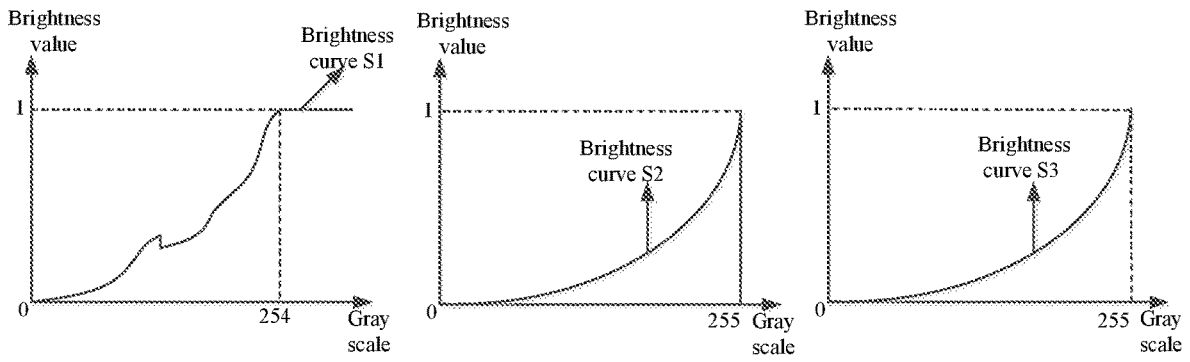
FIG. 3 shows grayscale brightness curves in the method for adjusting the displayed image provided by an embodiment of the present application.

In an embodiment, referring to FIG. 3, which shows grayscale brightness curves in the method for adjusting the displayed image provided by an embodiment of the present application, there are brightness curves for a plurality of color channels, that is, brightness curve S1, brightness curve S2 and brightness curve S3. The coordinate system of each brightness curve may include two axes, which are grayscale and brightness value. The brightness curve S1 may be a brightness curve of the blue channel, the brightness curve S2 may be a brightness curve of the red channel, and the brightness curve S3 may be a brightness curve of the green channel.

Step 205—determining a target color channel based on the brightness curves of different color channels.

After the brightness curve of each color channel is obtained, it may compare the trends of changes for the brightness curves to determine the brightness curve with abnormal trend of changes. The color channel corresponding to the brightness curve with abnormal trend of changes can serve as the target color channel.

For example, for the three curves of brightness changes as shown in FIG. 3, it can be determined that the trend of changes of brightness curve S1 is abnormal. Since the color channel the brightness curve S1 corresponds to is the blue channel, the blue channel can serve as the target color channel.

Step 206—obtaining stimulus curves of a plurality of primary-color stimulating amounts for the target color channel.

In an embodiment, the target color channel can be an abnormal color channel in the abnormal image frame. After the target color channel is determined, the problem of abnormal image brightness can be solved by processing the abnormal color channel.

The stimulus curves of the plurality of primary-color stimulating amounts for the target color channel are obtained, wherein the plurality of primary-color stimulating amounts may include a red stimulating amount, a green stimulating amount and a blue stimulating amount.

Figure 4:
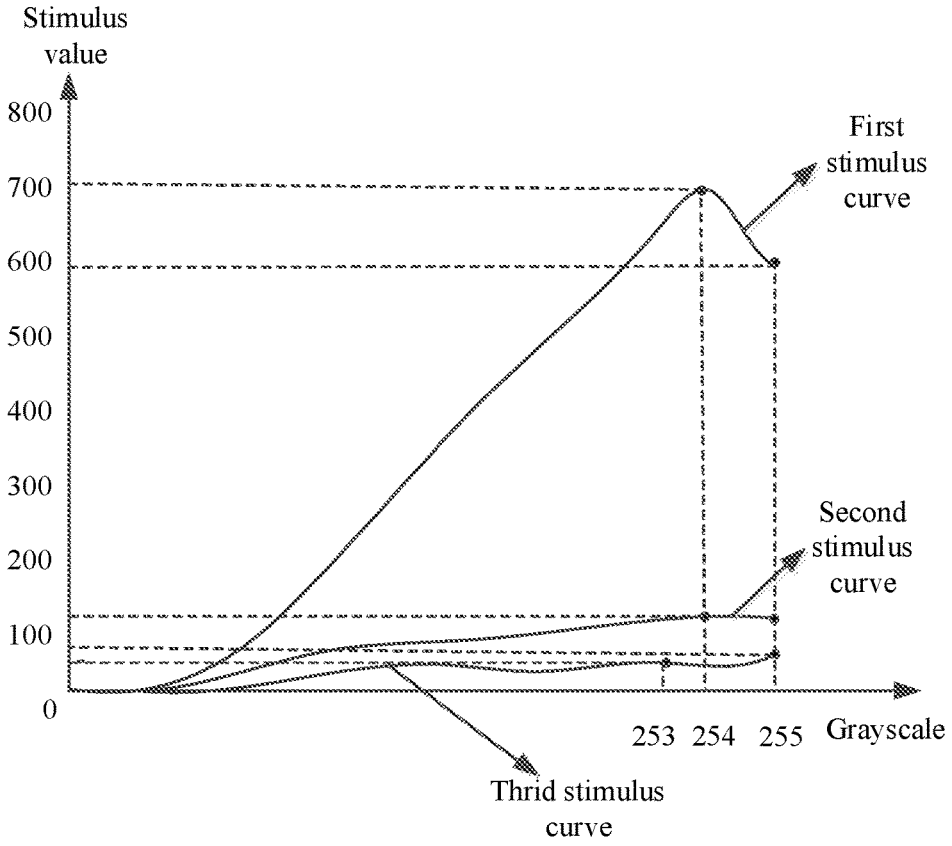
FIG. 4 shows grayscale stimulus curves in the method for adjusting the displayed image provided by an embodiment of the present application.

FIG. 4 shows grayscale stimulus curves in the method for adjusting the displayed image provided by an embodiment of the present application. In FIG. 4, there are a first stimulus curve, a second stimulus curve and a third stimulus curve. The first stimulus curve may be represented by a variation of stimulus values with respect to each grayscale for the green stimulating amount. The second stimulus curve may be represented by a variation of stimulus values with respect to each grayscale for the blue stimulating amount. The third stimulus curve may be represented by a variation of stimulus values with respect to each grayscale for the red stimulating amount.

The coordinate system of each stimulus curve may include two axes, which are grayscale and stimulus value.

Step 207—determining a grayscale of inversion based on the plurality of stimulus curves.

A first stimulus value and a second stimulus value of each stimulus value may be obtained. As shown in FIG. 4, the first stimulus value may be a maximum stimulus value of the stimulus curve, and the second stimulus value may be the stimulus value corresponding to the 255-th grayscale. Specifically, a stimulus-value difference of the stimulus curve is determined based on the first stimulus value and the second stimulus value of each stimulus curve.

After the stimulus-value difference of each stimulus curve is determined, a maximum stimulus-value difference can be determined based on a plurality of stimulus-value differences. The stimulus curve corresponding to the maximum stimulus-value difference is taken as a target stimulus curve. The grayscale corresponding to the first stimulus value of the target stimulus curve is obtained and may be taken as the target grayscale.

For example, in FIG. 4, the first stimulus value is 700 and the second stimulus value is 600 for the first stimulus curve; the first stimulus value is 110 and the second stimulus value is 110 for the second stimulus curve; the first stimulus value is 90 and the second stimulus value is 100 for the third stimulus curve. It can be determined that the stimulus-value difference of the first stimulus curve is 100, the stimulus-value difference of the second stimulus curve is 0, and the stimulus-value difference of the third stimulus curve is 10. Further, it can be determined that the maximum stimulus-value difference is 100. The maximum stimulus-value difference corresponds to the first stimulus curve. The 254-th grayscale corresponding to the have first stimulus value of the first stimulus curve may be taken as the grayscale of inversion. The grayscale of inversion can be represented by a turning point of stimulus values on the stimulus curve, and is located before the highest grayscale and corresponds to a stimulus value higher than the stimulus value corresponding to the highest grayscale.

Step 208—obtaining brightness and chromaticity of the grayscale of inversion and adjusting the brightness and chromaticity of other grayscales within the predetermined grayscale interval.

In an embodiment, when the grayscale of inversion is determined, the brightness and chromaticity of the grayscale of inversion can be obtained. Further, the brightness and chromaticity of the grayscale of inversion are taken as the brightness and chromaticity of the highest grayscale. The brightness and chromaticity of other grayscales are adjusted based on the adjusted brightness and chromaticity of the highest grayscale. The rule for the adjustment has been described in detail in the foregoing embodiments. Please refer to the foregoing embodiments for detail, and it is not repeated herein.

Figure 5:
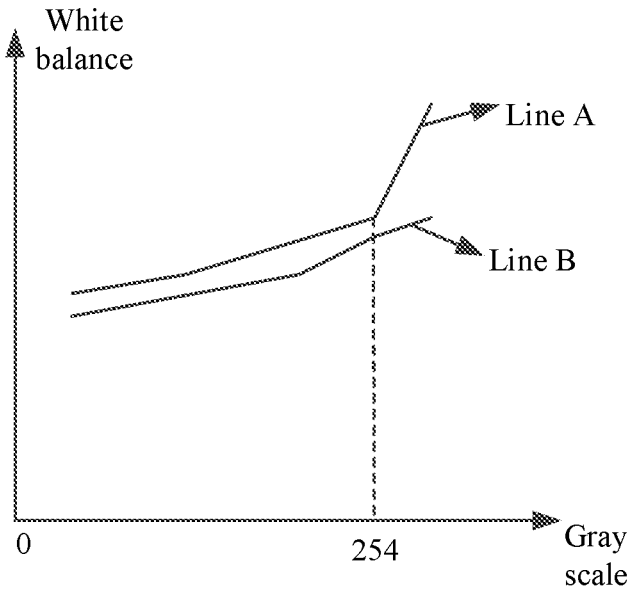
FIG. 5 shows a result of parameter adjustment in the method for adjusting a displayed image provided in an embodiment of the present application.

In an embodiment, referring to FIG. 5, which shows a result of parameter adjustment in the method for adjusting a displayed image provided in an embodiment of the present application, there is a white balance parameter corresponding to each grayscale. Line A indicates value variations of white balance before adjusting the brightness and chromaticity of a display image, and Line B indicates value variations of white balance after adjusting the brightness and chromaticity of a displayed image. As shown by a comparison result of FIG. 5, a sudden change of white balance parameter value occurs on Line A when the 254-th grayscale moves to a next grayscale. It is a great change and affects the display effect of the displayed image. Further, by the display adjustment method in the present application, the sudden change of white balance parameter is improved such that the white balance parameter makes a smooth transition at high grayscales, thereby improving the display effect of images, as indicated by Line B of FIG. 5.

The embodiment of the present application discloses a method for adjusting a displayed image. The method includes obtaining brightness information of a plurality of color channels of a currently displayed image; determining a target color channel with abnormal brightness from the plurality of color channels based on the brightness information; obtaining stimulus information of the target color channel, and determining a target grayscale from a predetermined grayscale interval based on the stimulus information; and determining brightness and chromaticity corresponding to the target grayscale, and adjusting the displayed image based on the brightness and chromaticity corresponding to the target grayscale. The solution of this application collects image frames with abnormal brightness, extracts the brightness information of the image frame, determines abnormal grayscale information of the image frame based on the brightness information, and adjusts display parameters of the image frame based on the abnormal grayscale information in order to reduce the brightness difference of the image frame, thereby improving the quality of displayed images.

In order to facilitate better implementation of the method for adjusting the displayed image provided in the embodiments of the present application, an embodiment of the present application further provides a device based on the afore-described method for adjusting the displayed image. The meanings of the terms used herein are as the same as that used in afore-described method for adjusting the displayed image, and details for these can refer to the description in the method embodiments.

Figure 6:
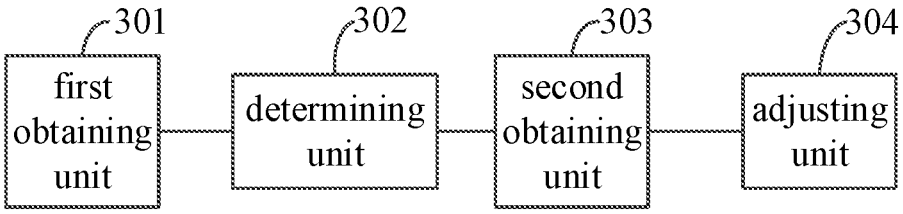
FIG. 6 is a structural diagram showing a device for adjusting a displayed image provided in an embodiment of the present embodiment.

FIG. 6 is a structural diagram showing a device for adjusting a displayed image provided in an embodiment of the present embodiment. The device for adjusting the displayed image is applicable to a display device such as a television. The device includes the following components.

a first obtaining unit 301, configured for obtaining brightness information of a plurality of color channels of a currently displayed image;

a determining unit 302, configured for determining a target color channel with abnormal brightness from the plurality of color channels based on the brightness information;

a second obtaining unit 303, configured for obtaining stimulus information of the target color channel, and determining a target grayscale from a predetermined grayscale interval based on the stimulus information; and an adjusting unit 304, configured for determining brightness and chromaticity corresponding to the target grayscale, and adjusting the displayed image based on the brightness and chromaticity corresponding to the target grayscale.

In an embodiment, the second obtaining unit 303 may include:

a first determining sub unit, configured for determining a trend of variation of each stimulus curve;

a second determining sub unit, configured for determining an abnormal stimulus curve from the plurality of stimulus curves based on the trend of variation; and a third determining sub unit, configured for determining the target grayscale from the predetermined grayscale interval based on stimulus variation information of the abnormal stimulus curve.

In some embodiments, the second determining sub unit can be configured for determining an amount of changes in stimulus values of the stimulus curves from each grayscale to an adjacent next grayscale based on the trend of variation; and in response to the amount of changes greater than a predetermined amount of changes, determining the stimulus curve corresponding to the amount of changes as the abnormal stimulus curve.

In some embodiments, the third determining sub unit can be configured for obtaining a first stimulus value and a second stimulus value of the abnormal stimulus curve, wherein the first stimulus value is a first maximum of the stimulus values of the abnormal stimulus curve, and the second stimulus value is a stimulus value of a highest grayscale within the predetermined grayscale interval on the abnormal stimulus curve; obtaining a stimulus-value difference between the first stimulus value and the second stimulus value; and in response to the stimulus-value difference greater than a predetermined threshold, taking the grayscale corresponding to the first stimulus value of the abnormal stimulus curve as the target grayscale.

In some embodiments, the second obtaining unit 303 may further include:

a fourth determining sub unit, configured for determining from the plurality of stimulus curves the stimulus curve, on which a second maximum of the stimulus values is, and taking the determined stimulus curve as a target stimulus curve; and a fifth determining sub unit, configured for determining a grayscale corresponding to the maximum of the stimulus values from the target stimulus curve, and taking the determined grayscale as the target grayscale.

In some embodiments, the determining unit 302 may further include:

a first obtaining sub unit, configured for obtaining a brightness difference corresponding to every two adjacent grayscales based on the brightness curves; and a six determining sub unit, configured for determining in response to the brightness difference not within a predetermined range of differences the color channel corresponding to the brightness difference as the target color channel.

In some embodiments, the adjusting unit 304 may include:

a second obtaining sub unit, configured for obtaining a brightness parameter value corresponding to the brightness and a chromaticity parameter value corresponding to the chromaticity;

a third obtaining sub unit, configured for obtaining a brightness difference of two adjacent grayscales;

a seventh determining unit, configured for determining a target brightness value of each grayscale in the predetermined grayscale interval based on the brightness parameter value and the brightness difference; and an adjusting sub unit, configured for adjusting the brightness value of each grayscale based on the target brightness value of each grayscale, and adjusting a chromaticity value of each grayscale based on the chromaticity parameter value of the target grayscale.

The embodiment of the present application discloses a device for adjusting a displayed image. The device includes obtaining brightness information of a plurality of color channels of a currently displayed image; determining a target color channel with abnormal brightness from the plurality of color channels based on the brightness information; obtaining stimulus information of the target color channel, and determining a target grayscale from a predetermined grayscale interval based on the stimulus information; and determining brightness and chromaticity corresponding to the target grayscale, and adjusting the displayed image based on the brightness and chromaticity corresponding to the target grayscale. The solution of this application collects image frames with abnormal brightness, extracts the brightness information of the image frame, determines abnormal grayscale information of the image frame based on the brightness information, and adjusts display parameters of the image frame based on the abnormal grayscale information in order to reduce the brightness difference of the image frame, thereby improving the quality of displayed images.

Figure 7:
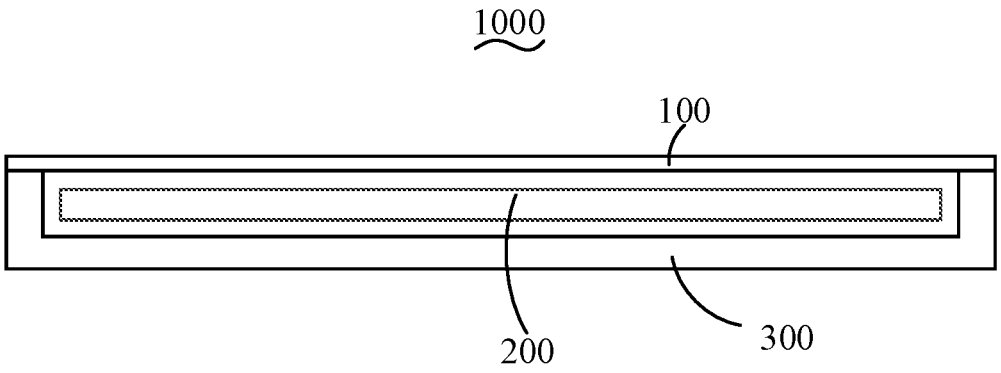
FIG. 7 is a structural schematic diagram showing a display device provided in an embodiment of the present application.

FIG. 7 is a structural schematic diagram showing a display device 1000 provided in an embodiment of the present application. The display device 100 may include an illuminating panel 100, a control circuit 200 and a housing 300. The display device may further include a device for adjusting a displayed image. The device for adjusting the displayed image can be configured to execute the method for adjusting the displayed image in the embodiments of the present application. It needs to be noted that the display device 1000 shown in FIG. 7 is not limited to above context, and may further include other devices such as a camera, an antenna and a fingerprint unlocking module, and so on.

The illuminating panel 100 is disposed on the housing 200.

In some embodiments, the illuminating panel 100 can be fixed to the housing 200. The illuminating panel 100 and the housing 300 define a sealed space for accommodating components, for example, the control circuit 200.

In some embodiments, the housing can be made of a flexible material. The housing 300 is a plastic housing or a silicon housing.

The control circuit 200 is mounted in the housing 300. The control circuit 200 may be a main board of the display device 1000. The control circuit 200 may be integrated with one, two or more of functional components such as a battery, an antenna structure, a microphone, a speaker, a headphone interface, a universal serial bus interface, a camera, a distance sensor, an ambient light sensor, a receiver and a processor.

The illuminating panel 100 is mounted in the housing 300. The illuminating panel 100 is electrically connected to the control circuit 200, forming a display panel of the display device. The illuminating panel 100 may include a display region and a non-display region. The display region can be used to display images on the display device 1000 or for users to carry out touch control. The non-display region can be used to display various of functional components.

Specifically, in the present embodiment, when the display region of the illuminating panel display images on the display device 1000, it can be realized the following functions:

obtaining brightness information of a plurality of color channels of a currently displayed image;

determining a target color channel with abnormal brightness from the plurality of color channels based on the brightness information;

obtaining stimulus information of the target color channel, and determining a target grayscale from a predetermined grayscale interval based on the stimulus information; and determining brightness and chromaticity corresponding to the target grayscale, and adjusting the displayed image based on the brightness and chromaticity corresponding to the target grayscale.

The embodiments of the present application disclose a method, device, storage medium and display device for adjusting a displayed image. The method for adjusting the displayed image includes obtaining brightness information of a plurality of color channels of a currently displayed image; determining a target color channel with abnormal brightness from the plurality of color channels based on the brightness information; obtaining stimulus information of the target color channel, and determining a target grayscale from a predetermined grayscale interval based on the stimulus information; and determining brightness and chromaticity corresponding to the target grayscale, and adjusting the displayed image based on the brightness and chromaticity corresponding to the target grayscale. The solution of this application collects image frames with abnormal brightness, extracts the brightness information of the image frame, determines abnormal grayscale information of the image frame based on the brightness information, and adjusts display parameters of the image frame based on the abnormal grayscale information in order to reduce the brightness difference of the image frame, thereby improving the quality of displayed images.

A person of ordinary skill in the art may understand that all or some of the steps in various methods of the foregoing embodiments may be implemented by program instructions, or may be implemented by a program instructing relevant hardware. The program instructions may be stored in a storage medium, and be loaded and executed by a processor.

For this, an embodiment of the present embodiment provides a storage medium, which stores a plurality of instructions that can be loaded by the processor to execute the steps of any of the method for adjusting the displayed image provided in the embodiments of the present application. For example, the instructions are allowed to execute the following steps:

obtaining brightness information of a plurality of color channels of a currently displayed image; determining a target color channel with abnormal brightness from the plurality of color channels based on the brightness information; obtaining stimulus information of the target color channel, and determining a target grayscale from a predetermined grayscale interval based on the stimulus information; and determining brightness and chromaticity corresponding to the target grayscale, and adjusting the displayed image based on the brightness and chromaticity corresponding to the target grayscale.

Implementation of above operations may refer to above embodiments, and is not repeated herein.

The storage medium may include a read only memory (ROM), a random access memory (RAM), a magnetic disk or an optic disc.

Since the instructions stored in the storage medium can execute the steps of any of the method for adjusting the displayed image provided in the embodiments of the present application, it can realize the beneficial effects achieved by any of the methods for adjusting the displayed image provided in the embodiments of the present application, which are referred to above embodiments and are not repeated herein.

Hereinbefore, the method, device, storage medium and display device for adjusting the displayed image provided in the embodiments of the present application are introduced in detail, the principles and implementations of the present application are set forth herein with reference to specific examples, descriptions of the above embodiments are merely served to assist in understanding the technical solutions and essential ideas of the present application. In addition, persons of ordinary skill in the art can make variations and modifications to the present application in terms of the specific implementations and application scopes according to the ideas of the present application. Therefore, the content of specification shall not be construed as a limit to the present application.

The invention claimed is:

1. A method for adjusting a displayed image, applied to a display apparatus, the method comprising:

obtaining brightness information of a plurality of color channels of a currently displayed image;

determining a target color channel with abnormal brightness from the plurality of color channels based on the brightness information;

obtaining stimulus information of the target color channel, and determining a target grayscale from a predetermined grayscale interval based on the stimulus information; and determining brightness and chromaticity corresponding to the target grayscale, and adjusting the displayed image based on the brightness and chromaticity corresponding to the target grayscale.

2. The method according to claim 1, wherein the stimulus information comprises a plurality of stimulus curves, and the stimulus curves are configured to represent tristimulus values varied with grayscale values;

wherein the determining the target grayscale from the predetermined grayscale interval based on the stimulus information comprises:

determining a trend of variation of each stimulus curve;

determining an abnormal stimulus curve from the plurality of stimulus curves based on the trend of variation; and determining the target grayscale from the predetermined grayscale interval based on stimulus variation information of the abnormal stimulus curve.

3. The method according to claim 2, wherein the determining the abnormal stimulus curve from the plurality of stimulus curves based on the trend of variation comprises:

determining an amount of changes in stimulus values of the stimulus curves from each grayscale to an adjacent next grayscale based on the trend of variation; and in response to the amount of changes greater than a predetermined amount of changes, determining the stimulus curve corresponding to the amount of changes as the abnormal stimulus curve.

4. The method according to claim 2, wherein the determining the target grayscale from the predetermined grayscale interval based on the stimulus variation information of the abnormal stimulus curve comprises:

obtaining a first stimulus value and a second stimulus value of the abnormal stimulus curve, wherein the first stimulus value is a first maximum of the stimulus values of the abnormal stimulus curve, and the second stimulus value is a stimulus value of a highest grayscale within the predetermined grayscale interval on the abnormal stimulus curve;

obtaining a stimulus-value difference between the first stimulus value and the second stimulus value; and in response to the stimulus-value difference greater than a predetermined threshold, taking the grayscale corresponding to the first stimulus value of the abnormal stimulus curve as the target grayscale.

5. The method according to claim 2, wherein the determining the target grayscale from the predetermined grayscale interval based on the stimulus variation information comprises:

from the plurality of stimulus curves, determining the stimulus curve, on which a second maximum of the stimulus values is, and taking the determined stimulus curve as a target stimulus curve; and determining a grayscale corresponding to the maximum of the stimulus values from the target stimulus curve, and taking the determined grayscale as the target grayscale.

6. The method according to claim 1, wherein the brightness information comprises brightness curves, and the brightness curves are configured to represent brightness values varied with grayscale values;

wherein the determining the target color channel with abnormal brightness from the plurality of color channels based on the brightness information comprises:

obtaining a brightness difference corresponding to every two adjacent grayscales based on the brightness curves; and in response to the brightness difference not within a predetermined range of differences, determining the color channel corresponding to the brightness difference as the target color channel.

7. The method according to claim 1, wherein the adjusting the displayed image based on the brightness and chromaticity corresponding to the target grayscale comprises:

obtaining a brightness parameter value corresponding to the brightness and a chromaticity parameter value corresponding to the chromaticity;

obtaining a brightness difference of two adjacent grayscales;

determining a target brightness value of each grayscale in the predetermined grayscale interval based on the brightness parameter value and the brightness difference; and adjusting the brightness value of each grayscale based on the target brightness value of each grayscale, and adjusting a chromaticity value of each grayscale based on the chromaticity parameter value of the target grayscale.

8. A non-transitory storage medium, which stores a plurality of instructions applicable to be loaded by a processor to execute the steps of:

obtaining brightness information of a plurality of color channels of a currently displayed image;

determining a target color channel with abnormal brightness from the plurality of color channels based on the brightness information;

obtaining stimulus information of the target color channel, and determining a target grayscale from a predetermined grayscale interval based on the stimulus information; and determining brightness and chromaticity corresponding to the target grayscale, and adjusting the displayed image based on the brightness and chromaticity corresponding to the target grayscale.

9. The non-transitory storage medium according to claim 8, wherein the stimulus information comprises a plurality of stimulus curves, and the stimulus curves are configured to represent tristimulus values varied with grayscale values;

wherein the determining the target grayscale from the predetermined grayscale interval based on the stimulus information comprises:

determining a trend of variation of each stimulus curve;

determining an abnormal stimulus curve from the plurality of stimulus curves based on the trend of variation; and determining the target grayscale from the predetermined grayscale interval based on stimulus variation information of the abnormal stimulus curve.

10. The non-transitory storage medium according to claim 9, wherein the determining the abnormal stimulus curve from the plurality of stimulus curves based on the trend of variation comprises:

determining an amount of changes in stimulus values of the stimulus curves from each grayscale to an adjacent next grayscale based on the trend of variation; and in response to the amount of changes greater than a predetermined amount of changes, determining the stimulus curve corresponding to the amount of changes as the abnormal stimulus curve.

11. The non-transitory storage medium according to claim 9, wherein the determining the target grayscale from the predetermined grayscale interval based on the stimulus variation information of the abnormal stimulus curve comprises:

obtaining a first stimulus value and a second stimulus value of the abnormal stimulus curve, wherein the first stimulus value is a first maximum of the stimulus values of the abnormal stimulus curve, and the second stimulus value is a stimulus value of a highest grayscale within the predetermined grayscale interval on the abnormal stimulus curve;

obtaining a stimulus-value difference between the first stimulus value and the second stimulus value; and in response to the stimulus-value difference greater than a predetermined threshold, taking the grayscale corresponding to the first stimulus value of the abnormal stimulus curve as the target grayscale.

12. The non-transitory storage medium according to claim 9, wherein the determining the target grayscale from the predetermined grayscale interval based on the stimulus variation information comprises:

from the plurality of stimulus curves, determining the stimulus curve, on which a second maximum of the stimulus values is, and taking the determined stimulus curve as a target stimulus curve; and determining a grayscale corresponding to the maximum of the stimulus values from the target stimulus curve, and taking the determined grayscale as the target grayscale.

13. The non-transitory storage medium according to claim 8, wherein the brightness information comprises brightness curves, and the brightness curves are configured to represent brightness values varied with grayscale values;

wherein the determining the target color channel with abnormal brightness from the plurality of color channels based on the brightness information comprises:

obtaining a brightness difference corresponding to every two adjacent grayscales based on the brightness curves; and in response to the brightness difference not within a predetermined range of differences, determining the color channel corresponding to the brightness difference as the target color channel.

14. The non-transitory storage medium according to claim 8, wherein the adjusting the displayed image based on the brightness and chromaticity corresponding to the target grayscale comprises:

obtaining a brightness parameter value corresponding to the brightness and a chromaticity parameter value corresponding to the chromaticity;

obtaining a brightness difference of two adjacent grayscales;

determining a target brightness value of each grayscale in the predetermined grayscale interval based on the brightness parameter value and the brightness difference; and adjusting the brightness value of each grayscale based on the target brightness value of each grayscale, and adjusting a chromaticity value of each grayscale based on the chromaticity parameter value of the target grayscale.

15. A display apparatus, comprising an image adjusting device comprising a processor configured to execute program instructions to execute the steps of:

obtaining brightness information of a plurality of color channels of a currently displayed image;

determining a target color channel with abnormal brightness from the plurality of color channels based on the brightness information;

obtaining stimulus information of the target color channel, and determining a target grayscale from a predetermined grayscale interval based on the stimulus information; and determining brightness and chromaticity corresponding to the target grayscale, and adjusting the displayed image based on the brightness and chromaticity corresponding to the target grayscale.

16. The display apparatus according to claim 15, wherein the stimulus information comprises a plurality of stimulus curves, and the stimulus curves are configured to represent tristimulus values varied with grayscale values;

wherein the determining the target grayscale from the predetermined grayscale interval based on the stimulus information comprises:

determining a trend of variation of each stimulus curve;

determining an abnormal stimulus curve from the plurality of stimulus curves based on the trend of variation; and determining the target grayscale from the predetermined grayscale interval based on stimulus variation information of the abnormal stimulus curve.

17. The display apparatus according to claim 16, wherein the determining the abnormal stimulus curve from the plurality of stimulus curves based on the trend of variation comprises:

determining an amount of changes in stimulus values of the stimulus curves from each grayscale to an adjacent next grayscale based on the trend of variation; and in response to the amount of changes greater than a predetermined amount of changes, determining the stimulus curve corresponding to the amount of changes as the abnormal stimulus curve.

18. The display apparatus according to claim 16, wherein the determining the target grayscale from the predetermined grayscale interval based on the stimulus variation information of the abnormal stimulus curve comprises:

obtaining a first stimulus value and a second stimulus value of the abnormal stimulus curve, wherein the first stimulus value is a first maximum of the stimulus values of the abnormal stimulus curve, and the second stimulus value is a stimulus value of a highest grayscale within the predetermined grayscale interval on the abnormal stimulus curve;

obtaining a stimulus-value difference between the first stimulus value and the second stimulus value; and in response to the stimulus-value difference greater than a predetermined threshold, taking the grayscale corresponding to the first stimulus value of the abnormal stimulus curve as the target grayscale.

19. The display apparatus according to claim 16, wherein the determining the target grayscale from the predetermined grayscale interval based on the stimulus variation information comprises:

from the plurality of stimulus curves, determining the stimulus curve, on which a second maximum of the stimulus values is, and taking the determined stimulus curve as a target stimulus curve; and determining a grayscale corresponding to the maximum of the stimulus values from the target stimulus curve, and taking the determined grayscale as the target grayscale.

20. The display apparatus according to claim 15, wherein the brightness information comprises brightness curves, and the brightness curves are configured to represent brightness values varied with grayscale values;

wherein the determining the target color channel with abnormal brightness from the plurality of color channels based on the brightness information comprises:

obtaining a brightness difference corresponding to every two adjacent grayscales based on the brightness curves; and in response to the brightness difference not within a predetermined range of differences, determining the color channel corresponding to the brightness difference as the target color channel.

* * * * *